US007629952B2

(12) United States Patent
Burr et al.

(10) Patent No.: US 7,629,952 B2
(45) Date of Patent: Dec. 8, 2009

(54) METHOD AND APPARATUS FOR REDUCING POWER CONSUMPTION IN DISPLAYS

(75) Inventors: Jeremy Burr, Portland, OR (US); Ralph M. Mesmer, Banks, OR (US)

(73) Assignee: Intel Corporation, Santa Clara, CA (US)

( * ) Notice: Subject to any disclaimer, the term of this patent is extended or adjusted under 35 U.S.C. 154(b) by 647 days.

(21) Appl. No.: 11/395,693

(22) Filed: Mar. 30, 2006

(65) Prior Publication Data

US 2007/0229485 A1 Oct. 4, 2007

(51) Int. Cl.
*G09G 3/36* (2006.01)

(52) U.S. Cl. ..... 345/87; 345/89; 345/98; 345/204; 345/295; 345/214; 345/690

(58) Field of Classification Search ..... 345/87, 345/89, 98, 204, 205, 690, 214
See application file for complete search history.

(56) References Cited

U.S. PATENT DOCUMENTS

| | | | | |
|---|---|---|---|---|
| 5,301,263 | A * | 4/1994 | Dowdell | 345/422 |
| 5,420,971 | A * | 5/1995 | Westerink et al. | 382/199 |
| 5,586,200 | A * | 12/1996 | Devaney et al. | 382/232 |
| 5,751,266 | A * | 5/1998 | Crossland et al. | 345/96 |
| 6,108,215 | A * | 8/2000 | Kates et al. | 363/17 |
| 2004/0141074 | A1 * | 7/2004 | Milkov et al. | 348/296 |
| 2004/0151374 | A1 * | 8/2004 | Lipton et al. | 382/181 |
| 2005/0078255 | A1 * | 4/2005 | Hiroshi | 349/141 |
| 2005/0219184 | A1 * | 10/2005 | Zehner et al. | 345/89 |
| 2006/0148569 | A1 * | 7/2006 | Beck | 463/43 |
| 2006/0208991 | A1 * | 9/2006 | Uekuri et al. | 345/98 |
| 2006/0221050 | A1 * | 10/2006 | Sakamoto et al. | 345/107 |
| 2008/0062290 | A1 * | 3/2008 | Lahav et al. | 348/280 |

OTHER PUBLICATIONS

"Intelligent Output Driver," 2003, www.adiabaticlogic.com, pp. 1-5.
http://i.cmpnet.com/eet/news04/March/SS1313_ADIABATIC_1_PG_62.gif.
http://i.cmpnet.com/eet/news04/March/SS1313_ADIABATIC_2_PG_62.gif.
Harvey, Geoff, "Efficient adiabatic circuits recyle I/O power," EETimes, Mar. 18, 2004, http://www.eetimes.com/article/showArticle.jhtml?articleId=18400898.
Kim, Dr. Paul H.J., "Pico power for giga performance," PicoNetics, Inc.

* cited by examiner

*Primary Examiner*—Bipin Shalwala
*Assistant Examiner*—Vince E Kovalick
(74) *Attorney, Agent, or Firm*—Blakely, Sokoloff, Taylor & Zafman LLP

(57) ABSTRACT

A method and apparatus for reducing power consumption in graphical displays is described. A display may includes decision logic to determine if a first pixel of the display will undergo a state transition, and if so, charge sharing switch logic switches the first pixel to a common bus for charge sharing with other pixels connected to the common bus. The pixels that are connected to the common bus share the voltage of the common bus. The pixels are then disconnected from the common bus and connected to the pixel driver. Other embodiments may be described.

19 Claims, 12 Drawing Sheets

METHOD AND APPARATUS FOR REDUCING POWER CONSUMPTION IN DISPLAYS

TECHNICAL FIELD

Some embodiments of the invention generally relate to graphics systems and displays used with computer systems. More specifically, some embodiments relate to power efficient operation of graphics systems and displays.

BACKGROUND

In recent years, efforts have been made to reduce the power requirements of computing devices. For mobile or portable devices operating from a battery or other constrained power supply, the efforts are directed to increasing the operational time of the device by prolonging the viability of the battery. Increasingly, there have been efforts to reduce the power requirements of all computing devices, for at least environmental reasons.

Conventional computing devices include at some point a display device. Display devices are typically one of the largest power consumers of a computing system.

Therefore, there is a need for a graphics system and parts thereof that provides advantages for power efficient displays.

BRIEF DESCRIPTION OF THE DRAWINGS

Various advantages of embodiments of the present invention will become apparent to one of ordinary skill in the art by reading the following specification and appended claims, and by referencing the following drawings, in which:

DESCRIPTION

Reference is made to some embodiments of the invention, examples of which are illustrated in the accompanying drawings. While the invention will be described in conjunction with the embodiments, it will be understood that they are not intended to limit the invention to these embodiments. On the contrary, the invention is intended to cover alternatives, modifications and equivalents, which may be included within the spirit and scope of the invention as defined by the appended claims. Moreover, in the following detailed description of the embodiments of the invention, numerous specific details are set forth in order to provide a thorough understanding of the invention. However, the embodiments of the invention may be practiced without these specific details. In other instances, well-known methods, procedures, components and circuits have not been described in detail as not to unnecessarily obscure aspects of the invention.

Some embodiments of a method, display, graphics system and computer system are described for power efficient operation of displays. The graphics system includes a processing system that includes logic for determining pixels of the display that are changing state between consecutive display frames, and for reducing power consumption during the state change by charge sharing. The terms 'video data' and frame data' are used interchangeably. In some embodiments, it may be convenient to think of video data as potentially including information about more than one frame of video; and frame data as including information about a single frame, but this is not a strict classification of the terms. Rather, the terms are used to inform the reader of the focus of the components or processes of the embodiments of the invention, such as, the data being processed.

Figure 1:
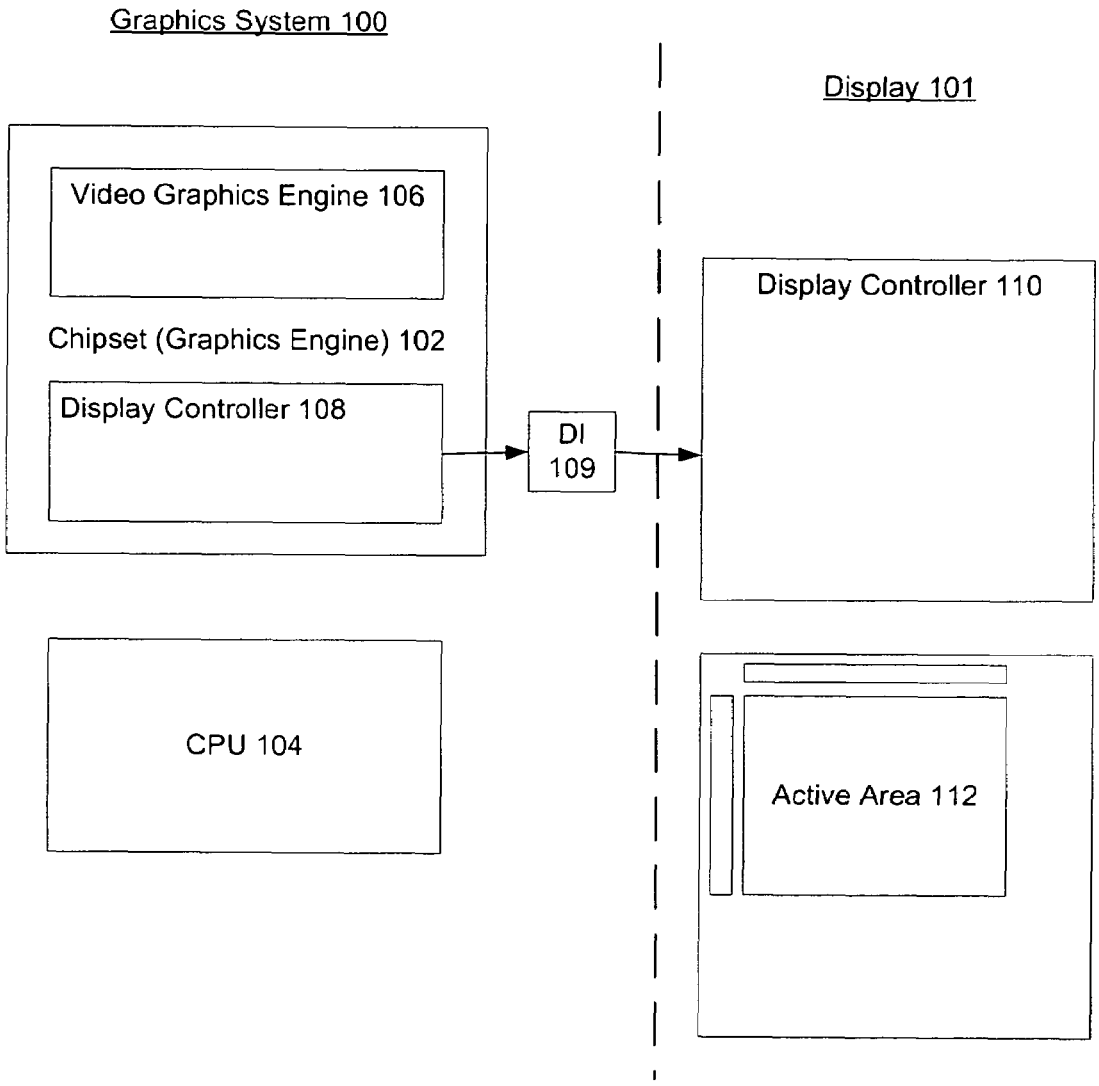
FIG. 1 illustrates a computer system with a graphics system and a display according to some embodiments of the invention.

FIG. 1 illustrates a computer system with a graphics system 100 and a display 101 according to some embodiments of the invention. The computer system may include one or more central processing units (CPUs) 104, according to some embodiments of the invention. The CPU 104 may include one or more processing cores and may be manufactured by Intel® Corporation. In some embodiments, the CPU 104 may be manufactured by another.

According to some embodiments of the invention, the graphics system 100 may include a chipset 102, which may also provide a graphics engine through a combination of hardware and software/firmware. In some embodiments, the chipset 102 may also be called a processing system, and may include a video graphics engine 106 and a display controller 108. The graphics system 100 may optionally include a display interface (DI) 109 to provide video data from the chipset 102 to the display 101. The DI 109 may communicate using low-voltage differential signaling (LVDS) to and/or from the graphics system and the display. Accordingly, the frame data or video data may be forwarded to the display 101 via DI 109.

The display 101 may include a self-refresh (SR) display controller 110. In some embodiments, the SR-display controller 110 may include, among other things, a signal receiver, such as, but not limited to a LVDS receiver, a timing controller, and a look up table (LUT).

In some embodiments of the invention, the controller 110 may provide the frame data to an active area 112 of the display for the formation of one or more images.

According to some embodiments of the invention, the display controller 110 may be a liquid crystal display (LCD) controller, or equivalent controller with the additional functions of the embodiments of the invention. Furthermore, the display 101, in some embodiments, may be a LCD display, or other displays with pixels, and various types of these displays, for example, a low temperature poly silicon (LTPS) LCD display.

Figure 2:
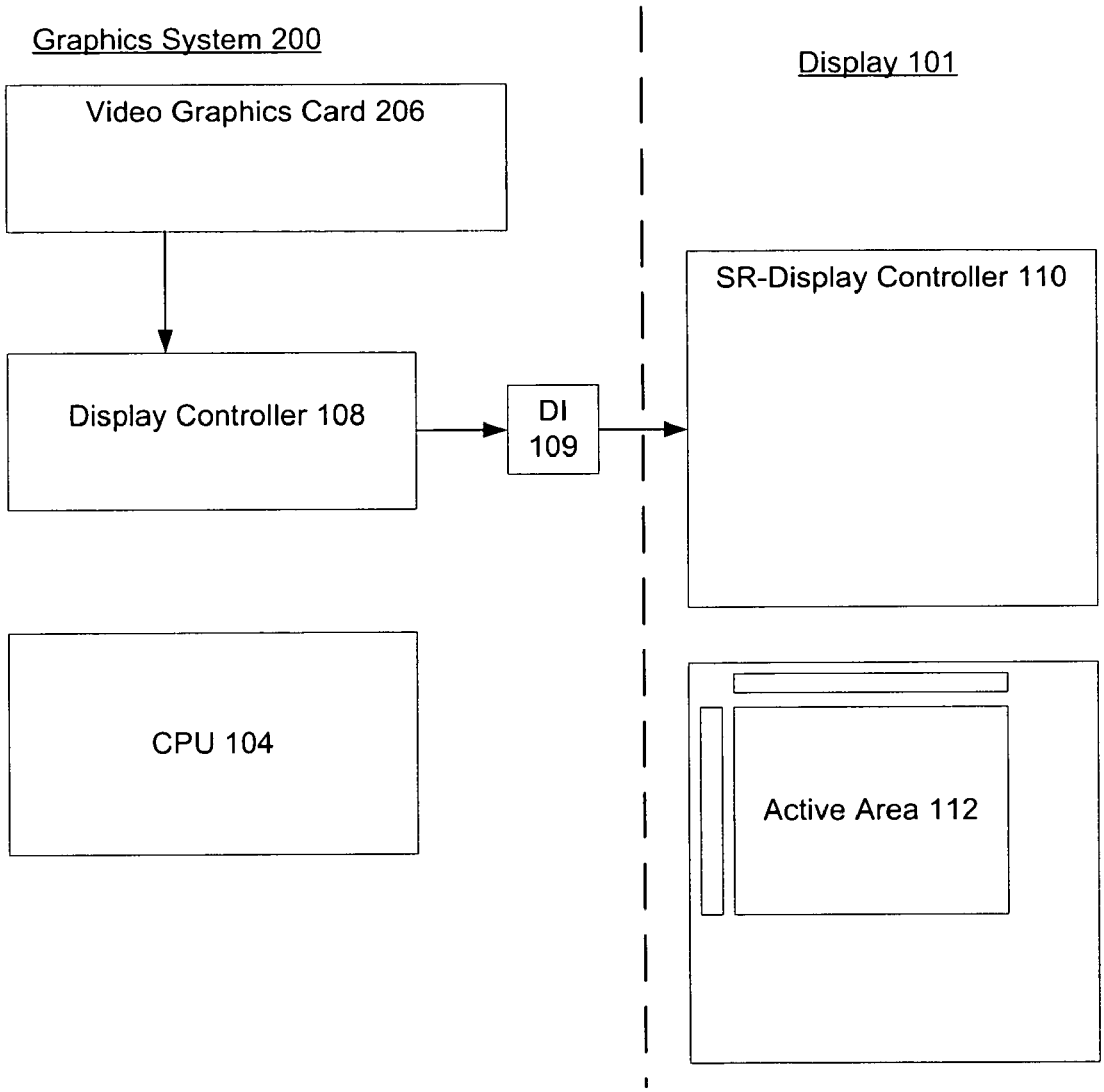
FIG. 2 illustrates a display system in which one embodiment of the invention can be practiced.

FIG. 2 illustrates a computer system with a graphics system 200 and the display 101 according to some embodiments of the invention. The graphics system 200 includes a different architecture than graphics system 100, yet it may, according to some embodiments of the invention, perform the identical functions as described elsewhere herein. Specifically, the graphics system 200 may include a video graphics card 206. The card 206 may include the display controller 108 or the controller 108 may be on a separate board or card (as shown), according to some embodiments of the invention.

Figure 3:
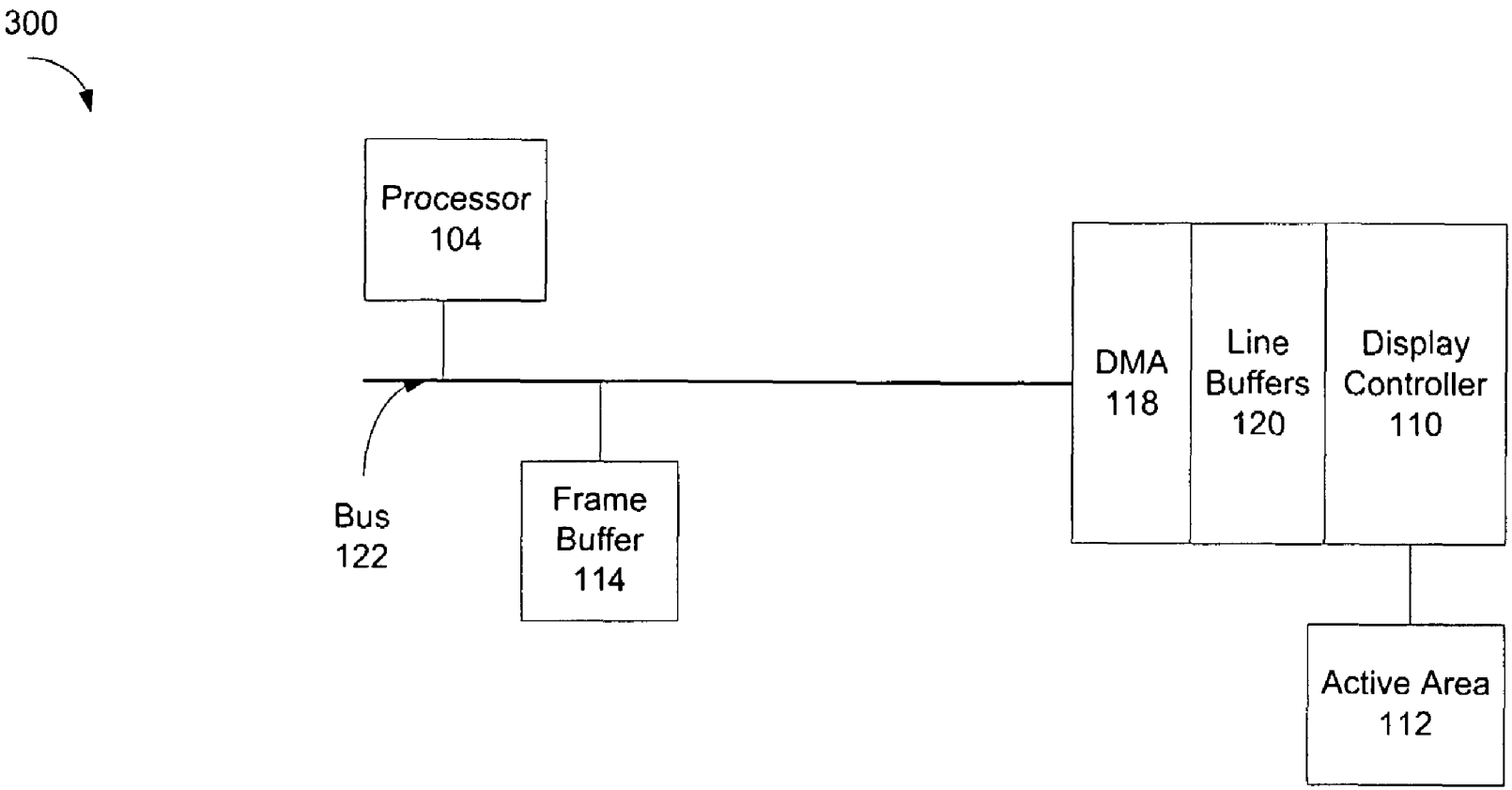
FIG. 3 illustrates a display system according to some embodiments of the invention.

FIG. 3 illustrates a display system 300 according to some embodiments of the invention. A processor 104 is coupled to a bus 122. A frame buffer 114 is also coupled to bus 122. The frame buffer 114 may be a portion of a main memory. Also coupled to bus 122 is dedicated direct memory access controller (DMA) 118 that extracts display data from the frame buffer 114 and puts the display data in the line buffers 120 to be output by the display controller 110 to the active area 112.

Figure 4:
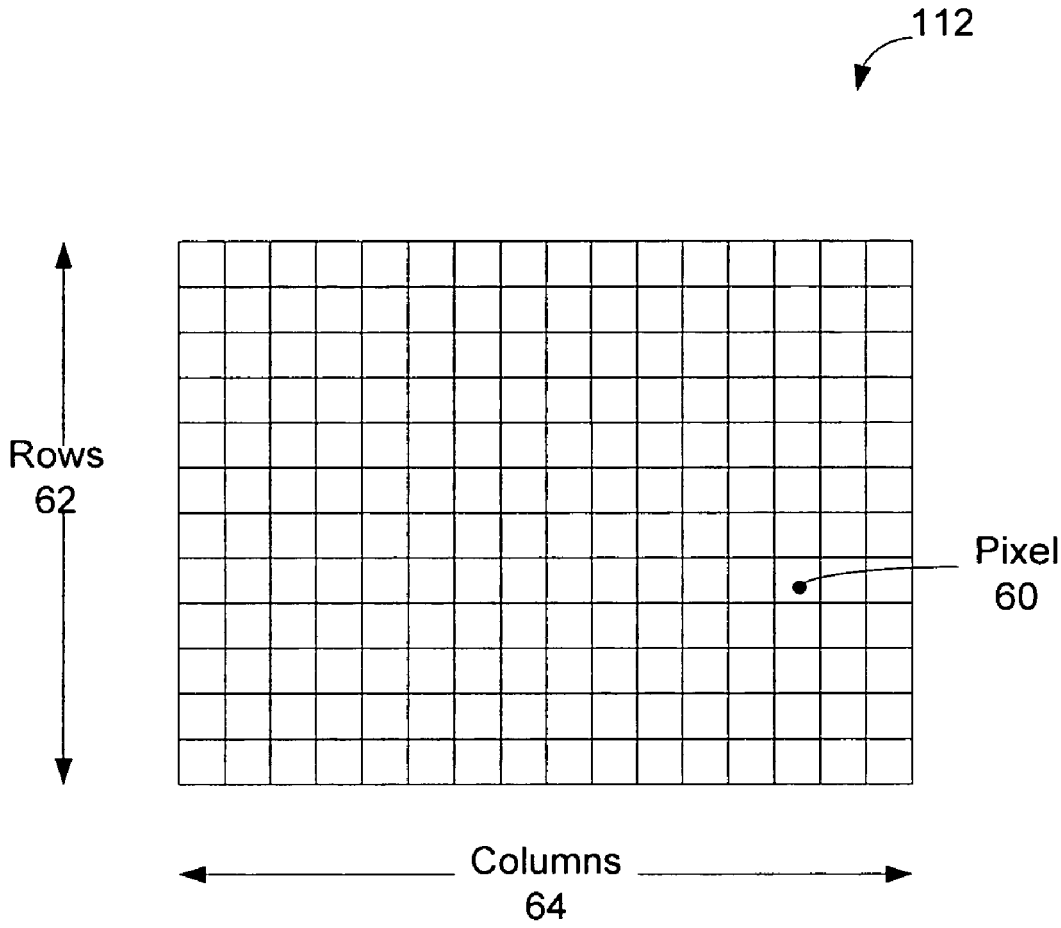
FIG. 4 is a diagram illustrating a display screen.

Referring to FIG. 4, an active area 112 comprises a plurality of pixels 60 that are arranged in rows 62 and columns 64. Active area 112, as shown, is composed of rows 62 and columns 64 of pixels 60 in a two-dimensional array. In some embodiments of the invention, active area 112 may have pixel arrays that have more than two dimensions, such as three-dimensional or quasi-three dimensional pixel arrays. The rows and columns uniquely address the active area's individual pixels, and communicate the required color and intensity data to each of the individual pixels. The information to be displayed is typically passed to the display one frame at a time. The information is displayed and then the next frame of information is passed to the display. In some embodiments, this process may repeat itself. In some embodiments, it may repeat in a sequential manner.

Power consumption of the active area 112 during operation depends on the display input capacitance, voltage and frequency. For instance, power consumption of the active area 112 during operation can be based on the following formula: Energy=0.5*Capacitance*Voltage$^2$*Frequency. The capacitance and frequency terms are typically constrained by the physical design of the active area elements and the display refresh requirements.

According to some embodiments of the invention, it is possible to affect the voltage term to reduce energy consumed by the active area 112. Because energy is proportional to Voltage$^2$, reducing the voltage term significantly reduces the energy required to power the active area 112. According to some embodiments of the invention, the voltage term is affected by affecting how charge is transferred onto the pixel inputs.

The inputs for active areas typically appear as capacitive loads, with minimal Direct Current (DC) requirements. Of course, other load models can also be used. Further, display technologies, such as bistable interferometric displays have two states, and pixels are held in one of the two states during display of information. Positive or negative charge transfer onto or from the inputs of the display elements within these displays affects the pixel's output state. Power is consumed while work is done changing the output states of the display's pixels and after this change has finished, then minimal energy is required to maintain the display's new pixel states. Typically, the energy required to change the output state of the display's pixels (from on-state to off-state, and from off-state to on-state) is dissipated. According to some embodiments of the invention, instead of dissipating the energy required to change the output state of the display's pixels, at least a portion of the energy is reused, thus reducing the bistable display's overall power requirements. Other displays, such as monochrome displays, color displays, multiple bit-per-pixel displays, 3D displays, quasi-3D displays, bistable displays with multiple bits per color, bistable displays with multiple colors, bistable displays with pixels of different physical areas, or bistable displays with pixels having different load capacitances may also be used.

Figure 5:
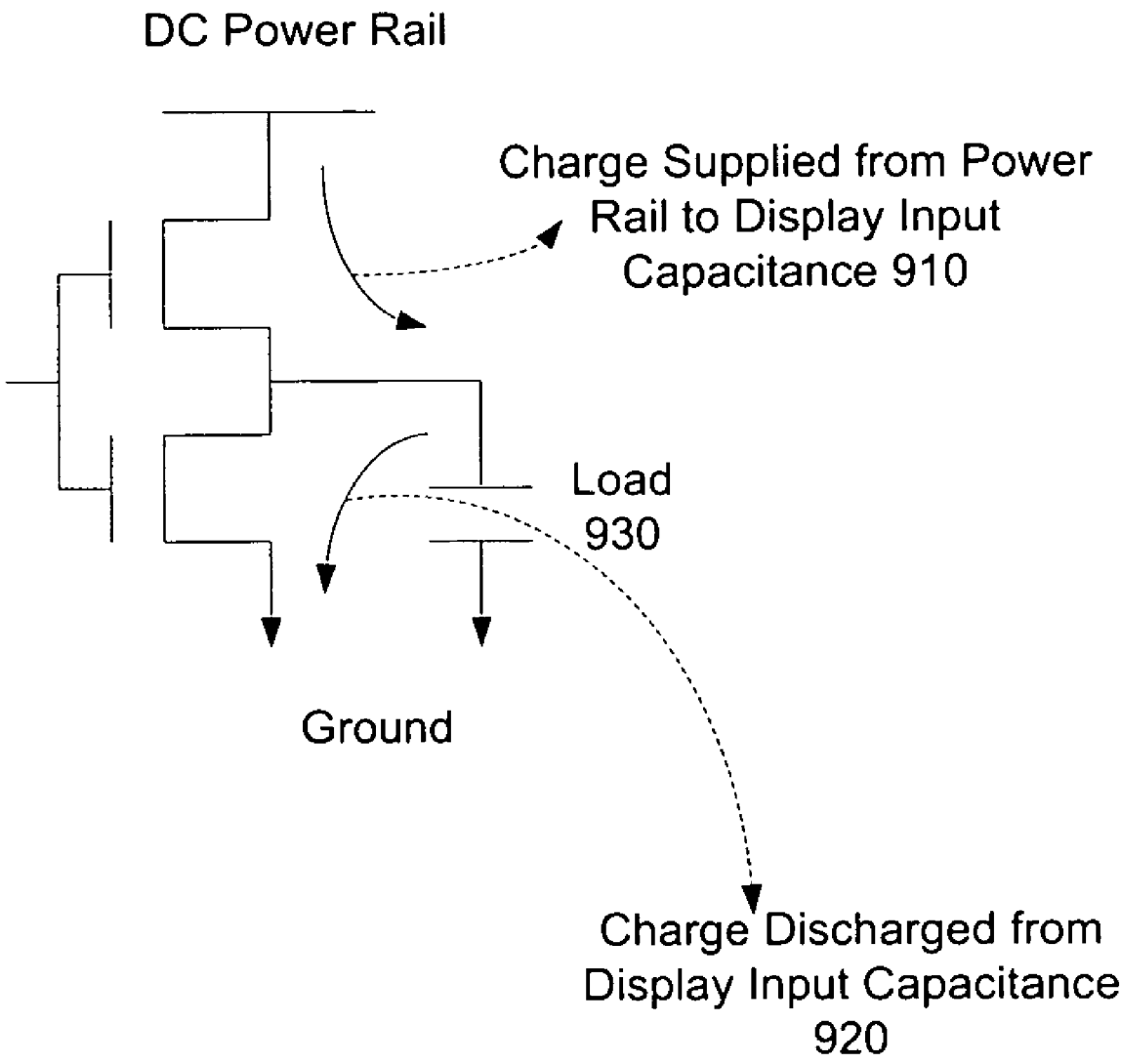
FIG. 5 is an example illustration of charge movement during pixel state change using a complementary metal-oxide semiconductor (CMOS)

FIG. 5 is an example illustration of charge movement during pixel state change using a complementary metal-oxide semiconductor (CMOS). When a pixel input is held at the power output state of DC power rail voltage, i.e., Vcc, the pixel output displays a first state, for instance "ON". When a pixel input is held at the power output state of ground, the pixel output displays a second state, for instance "OFF". As shown in FIG. 5, charge is supplied from DC power rail to the input capacitance of a pixel to change the state of the pixel from an "OFF" state to an "ON" state, while charge is discharged to ground change the state of the pixel from an "ON" state to an "OFF" state.

According to some embodiments of the invention, power consumption may be further reduced within the uni-directional information flow of existing display device drivers (i.e., from display controller 110 to active area 112) by determining the pixel state changes locally to each pixel affected.

According to some embodiments of the present invention, power consumption by an active area of a display is reduced by reducing the voltage swing required to power the pixels of the display. The pixels that are changing state between consecutive display frames are isolated, such that power is consumed by only those pixels that are changing state. In this way, power is not consumer/wasted by changed pixels when their state is not changing between frames. Further, the power consumed during the state change is reduced by charge sharing, for instance by using a common bus for charge sharing, between the pixels that are in state transition.

Figure 6:
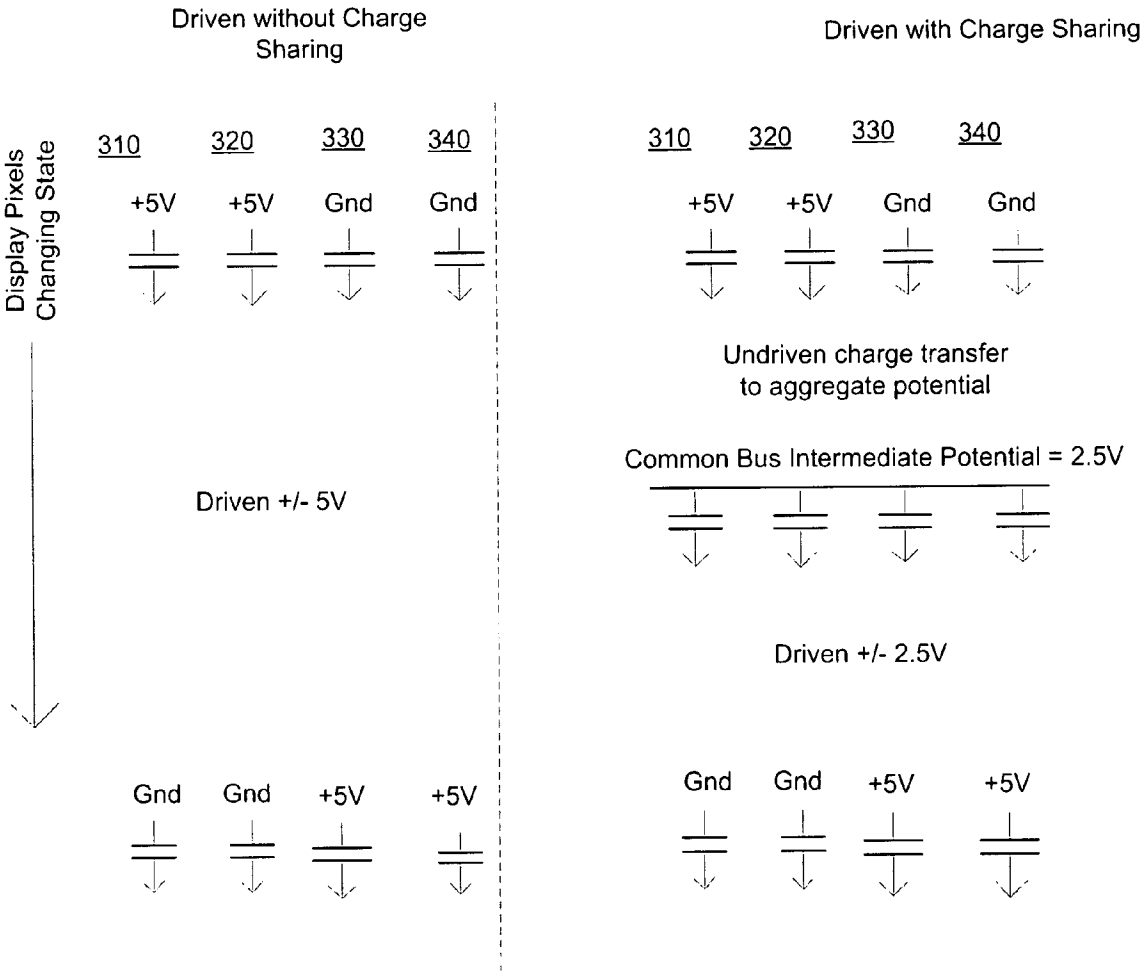
FIG. 6 illustrates pixels being driven with charge sharing according to some embodiments of the invention.

Even though the intermediate aggregate potential of the common bus may not be exactly half way between the two driven potentials (power rail, ground), any potential that is not the power rail or ground will reduce the total energy consumed by the display during pixel state transitions. An example illustration is provided in FIG. 6. FIG. 6 provides a comparison of pixels that are driven with charge sharing according to some embodiments of the invention with pixels that are driven conventionally without charge sharing. The pixels 310 and 320 are shown to be at +5 Volts (V) before the state transition and pixels 330 and 340 are shown to be at ground before the state transition. When conventionally driven without charge sharing, each pixel is driven +/−5V to change the state. Thus, after the state transition, pixels 310 and 320 are shown to be at ground, while pixels 330 and 340 are shown to be at +5V. In contrast, when the pixels 310, 320, 330 and 340 are driven with charge sharing according to some embodiments of the invention, each pixel is driven only a +/−2.5V to achieve the state transition. In this case, the common bus intermediate potential is equal to (5V+5V+0V+0V)/4=2.5V. Because energy required to power the display is proportional to voltage squared, the energy required in this example is four times less when charge sharing is implemented.

Figure 7:
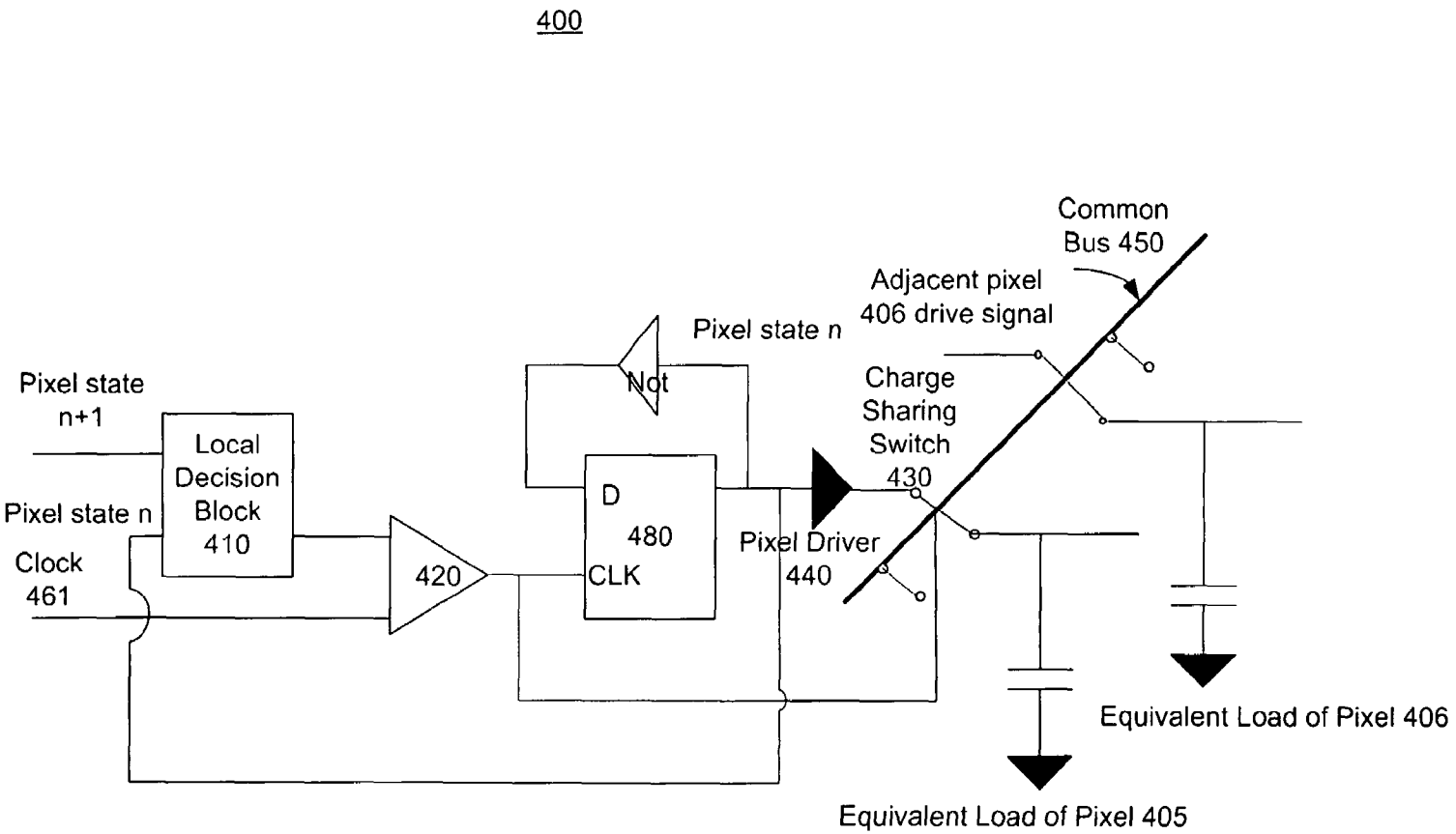
FIG. 7 is a schematic illustrating an embodiment of a system to reduce power consumption in graphical displays.

FIG. 7 is a schematic illustrating an embodiment of a system 400 to reduce power consumption in graphical displays. For a pixel 405, a decision block 410 receives as input the current pixel state ("n") and the next pixel state ("n+1"). The next pixel state "n+1" is received from the display controller 110. The decision block 410 is local to each pixel of the active area 112. The local decision block 410 determines if the pixel state needs to be changed. In certain embodiments, the local decision block 410 can be implemented using an exclusive OR (XOR) gate and may have a binary output. These local decisions may reduce the amount of energy required by a display by limiting the number of pixels changing state to the required minimum. According to some embodiments of the present invention, the local decisions may be implemented without charge sharing.

The output of the local decision block 410 is input to an AND gate 420. A clock pulse 461 is also input to the AND gate 420. The output of the AND gate 420 is used by a charge sharing switch 430 to determine whether to switch the pixel 405 from a pixel driver 440 to a common bus 450 for charge sharing using the charge sharing switch 430.

Also shown in FIG. 7 is an adjacent pixel 406 that has also been switched onto the common bus for charge sharing 450 by its respective charge sharing switch 430. The charge sharing switch 430 disconnects the pixel 405 and the pixel 406 from the common bus 450 and to the respective pixel drivers. The pixel driver 440 drives the state transition.

The output of the AND gate 420 is also fed as a clock pulse to a flip flop 480. The flip flop 480 is used to store the current pixel state n.

Figure 8:
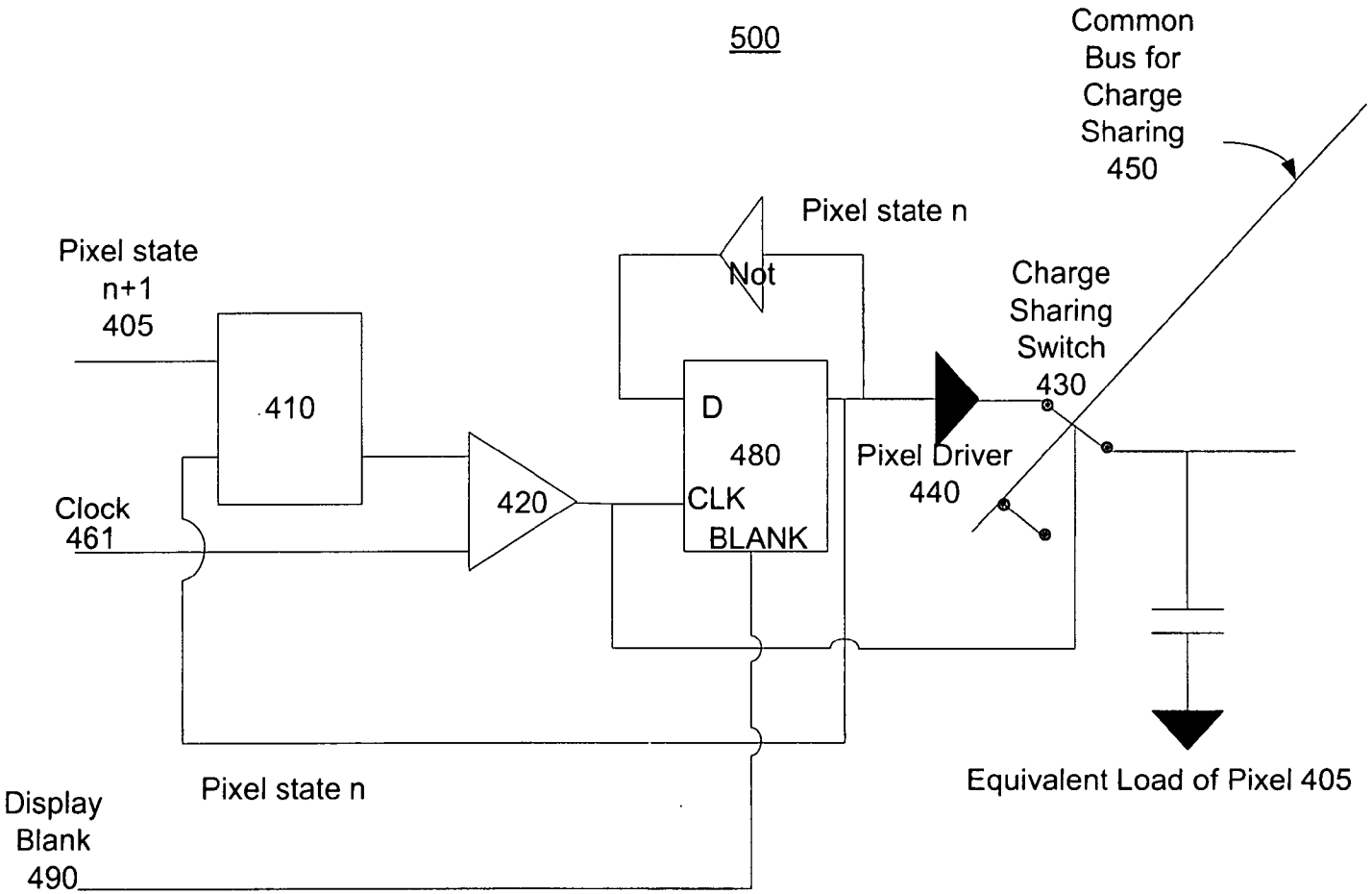
FIG. 8 is a schematic illustrating an embodiment of a system to reduce power consumption in graphical displays.

FIG. 8 is a schematic illustrating an embodiment of a system 500 to reduce power consumption in graphical displays. FIG. 8 is similar to FIG. 7 except that, in FIG. 8, a "Display Blank" signal 490 is introduced, such that the display can be reset to a known state during initialization.

Figure 9:
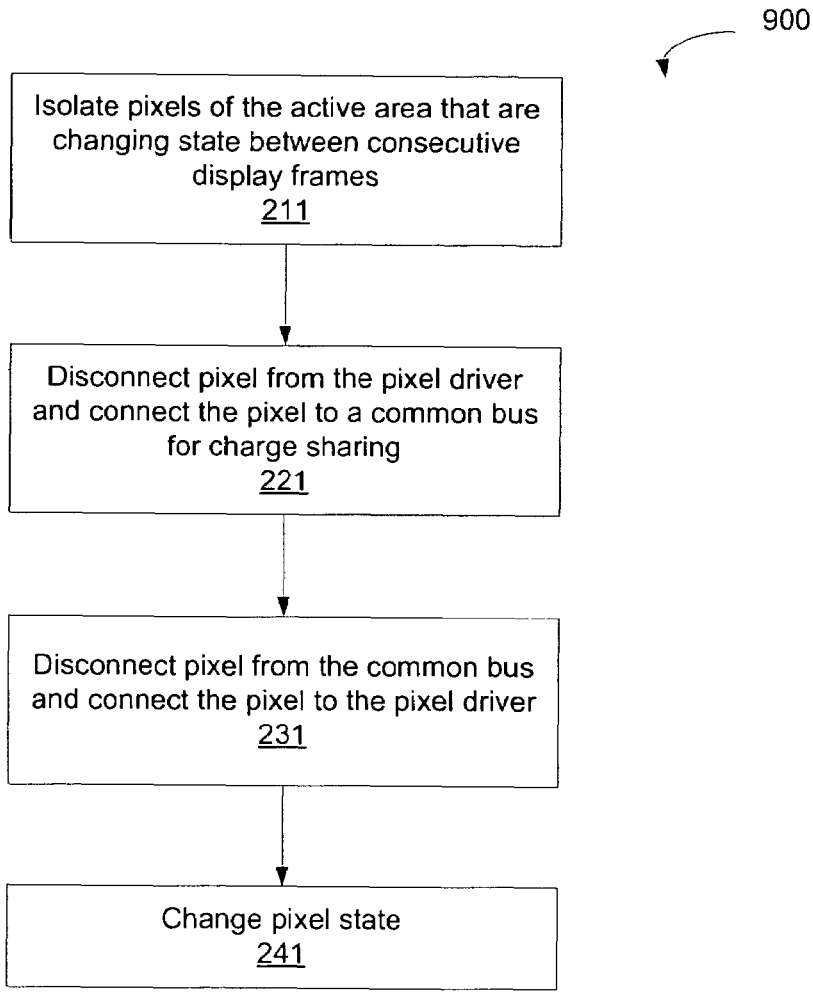
FIG. 9 illustrates a flowchart illustrating a process to reduce power consumption by a display screen according to one embodiment of the invention.

FIG. 9 illustrates a flowchart illustrating a process 900 to reduce power consumption by an active area 112 according to one embodiment of the invention. At block 211, the process 900 isolates those pixels of the graphical active area 112 that are changing state between consecutive display frames. For instance, certain pixels of the graphical active area 112 may be changing from an 'ON' state to 'OFF' or vice-a-versa. Many graphical displays, such as bistable displays, save information about the state of each pixel locally within the display. In certain embodiments, a newly desired pixel state, as received from a display driver, is compared with the saved previous state. A local decision is made about whether the pixel state is to be changed. At block 211, if the pixel is state is not going to be changed, no further energy is required. If however, the pixel state is to be changed, it requires energy to change state. The local decisions can reduce the amount of energy required by the display by limiting the number of pixels changing state to the minimum required.

At block 221, if the local decision specifies that the state of a pixel is to be changed, then the pixel is disconnected from the pixel driver and connected to a common bus for charge sharing. While connected to the common bus, the pixel shares its local charge with the other pixels that have also been connected to the common bus. In some embodiments, entire rows of pixels, or select pixels thereof, may be connected to the common bus for charge sharing. Pixels carrying a grounded potential will partially pull down the common bus potential, and pixels with a potential equal to the power rail will charge up the common bus potential. Accordingly, the common bus will migrate to an intermediate charge potential equal to the net positive and negative charges on the connected pixel loads.

At block 231, each pixel load connected to the common bus, and thus holding a potential equal to the potential of the common bus, is connected to the pixel driver. At block 241, the pixel state is changed. The pixel load will be driven to the appropriate potential based on the new desired state, not from the state at block 211, but with the common bus potential. The common bus potential, in most cases, will be a value intermediate to the DC power rail and ground.

Process 900 only affects those pixels that must change. Thus, there is no power increase associated with hooking all the pixels up to the common bus each cycle, because otherwise extra energy would be required to drive pixels that are to remain in the initial state back to their unchanged state.

The method and system for reducing power consumption in graphical displays may be utilized in displays that have the ability of storing the previous state of each pixel. One such display is a display that utilizes bistable interferometric technology. Bistable displays typically retain information abut the pixel state locally. In some bistable displays, voltage on the input of each pixel must be applied to maintain the bistable state. This voltage is typically maintained locally to the pixel, on a per pixel basis, and may only be changed when the pixel is refreshed.

Figure 10:
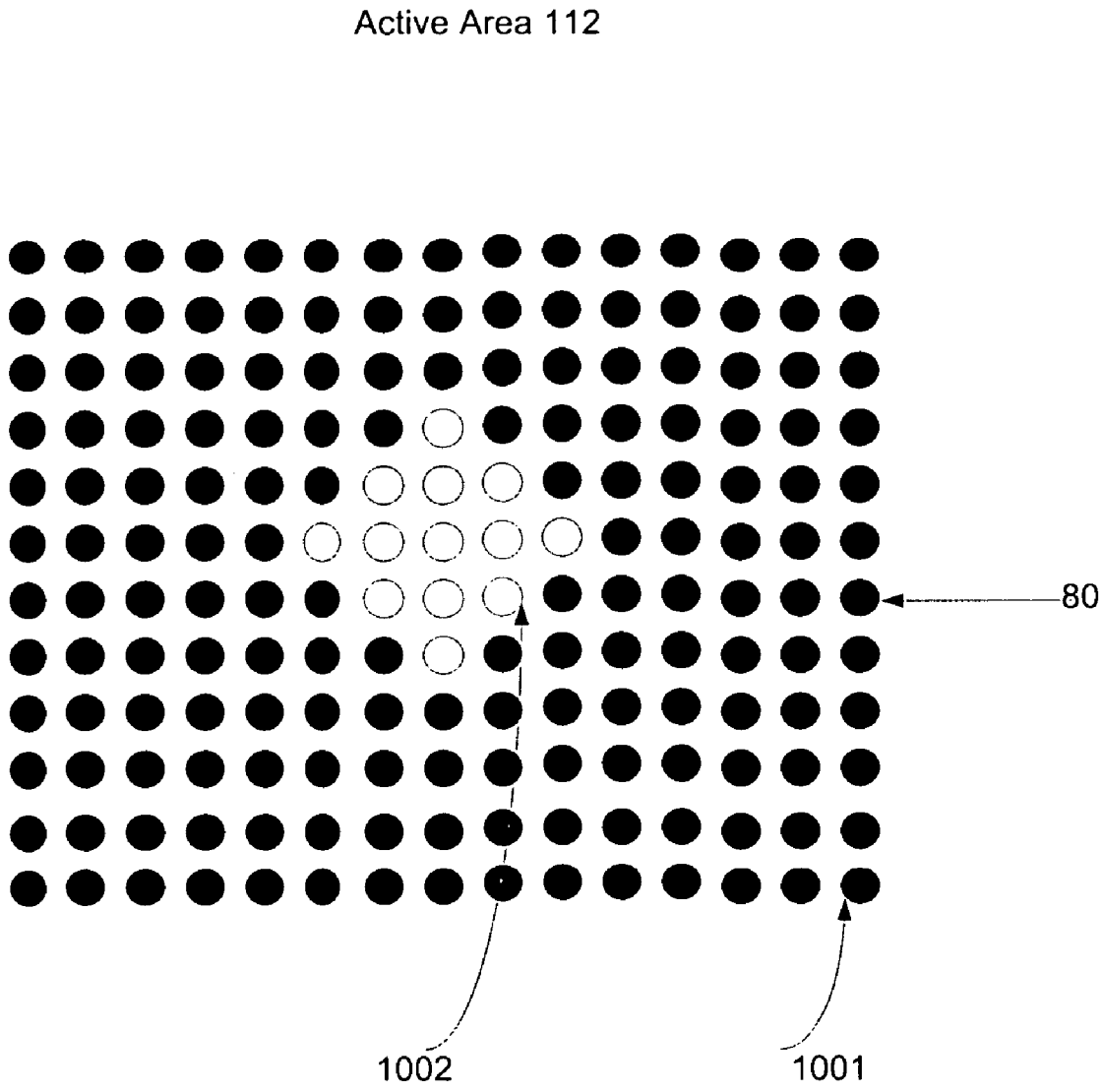
FIG. 10 illustrates a white ball moving across a display's black background.
Figure 11:
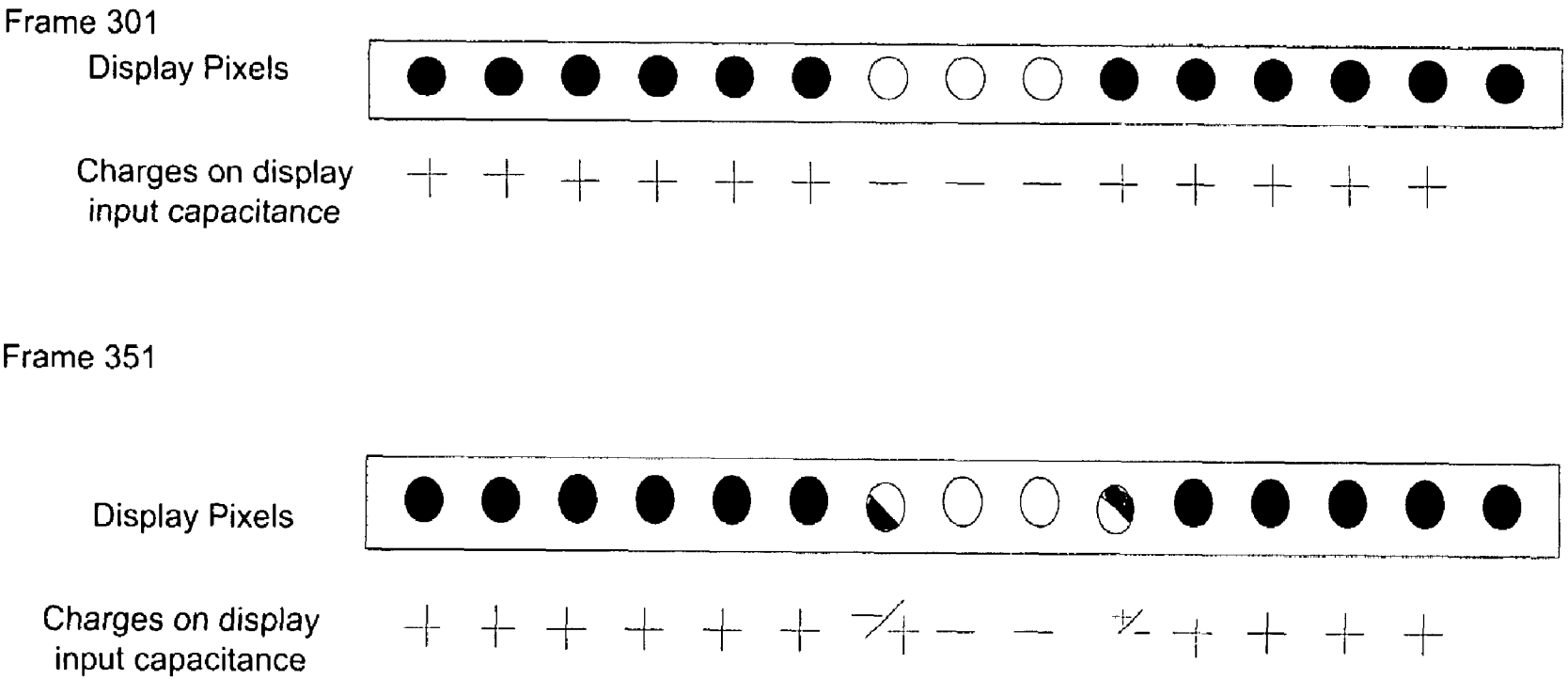
FIG. 11 illustrates a single row of a display screen over two frames.

The process 900 and systems 400 and 500 utilize the idea that the overall brightness of the display typically will be very similar from one frame to the next. This concept is illustrated in FIG. 10, which illustrates a white ball 1002 on a black background 1001. As the white ball 1002 moves from left to right across the active area 112, for every pixel that changes from black to white (on the right hand side of the screen), there is an equivalent pixel changing from white to black (on the left hand side of the screen). FIG. 11 illustrates a single row 80 of the active area 112 over two frames 301 and 351. The row 80 is a one-dimensional display with the white ball moving horizontally across a single row of pixels. As the white ball moves from left to right across the screen, for every pixel that changes from black to white (on the right hand side of the screen) in frame 301, there is an equivalent pixel changing from white to black (on the left hand side of the screen) in successive frame 351. Between the adjacent frames 301 and 351, on average, there will be as many white pixels changing to black pixels as there will be black pixels converting to white pixels.

Thus, the overall brightness of the active area 112 typically will be very similar from one frame to the next. In FIG. 11, while a positive charge on the input capacitance of the active area 112 is used to indicate darkness (or off-state) and a negative charge on the input capacitance of the active area 112 is used to indicate brightness (or on-state), the charges could be the other way around. Thus, a positive charge on the input capacitance of the active area 112 may be used to indicate brightness (or on-state) and a negative charge on the input capacitance of the active area 112 is used to indicate darkness (or off-state). In either case, during state transition (i.e., when an individual pixel transitions from on-state (brightness) to off-state (darkness) or from off-state (darkness) to on-state (brightness)), there is movement in the charge. For instance, in frame 301, pixel 311 is in on-state (brightness) and corresponding charge on the input capacitance is negative. Also, in frame 301, pixel 312 is in off-state (darkness) and corresponding charge on the input capacitance is positive. In frame 351, pixel 311 is changing from on to off and corresponding charge on the input capacitance is changing from negative to positive. Also, in frame 301, pixel 312 is changing from off to on and corresponding charge on the input capacitance is changing from positive to negative.

Figure 12:
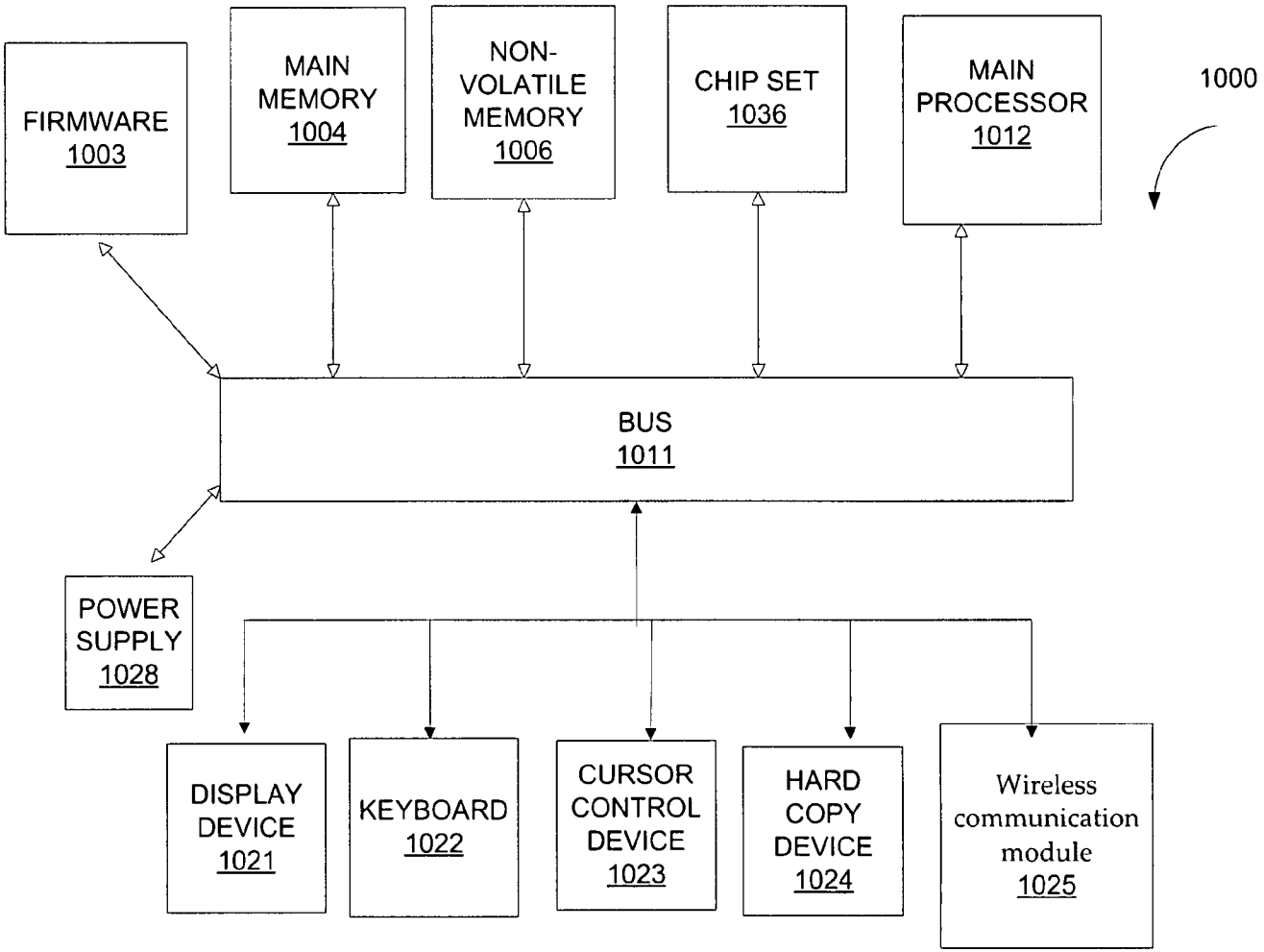
FIG. 12 illustrates a block diagram of an example computer system that may use an embodiment of methods and apparatus for reducing power consumption in graphical displays.

FIG. 12 illustrates a block diagram of an example computer system that may use an embodiment of methods and apparatus for reducing power consumption in graphical displays. In one embodiment, computer system 1000 comprises a communication mechanism or bus 1011 for communicating information, and an integrated circuit component such as a main processing unit 1012 coupled with bus 1011 for processing information. One or more of the components or devices in the computer system 1000 such as the main processing unit 1012 or a chip set 1036 may use an embodiment of the methods and apparatus for reducing power consumption in graphical displays. The main processing unit 1012 may consist of one or more processor cores working together as a unit.

Computer system 1000 further comprises a random access memory (RAM) or other dynamic storage device 1004 (referred to as main memory) coupled to bus 1011 for storing information and instructions to be executed by main processing unit 1012. Main memory 1004 also may be used for storing temporary variables or other intermediate information during execution of instructions by main processing unit 1012.

Firmware 1003 may be a combination of software and hardware, such as Electronically Programmable Read-Only Memory (EPROM) that has the operations for the routine recorded on the EPROM. The firmware 1003 may embed foundation code, basic input/output system code (BIOS), or other similar code. The firmware 1003 may make it possible for the computer system 1000 to boot itself.

Computer system 1000 also comprises a read-only memory (ROM) and/or other static storage device 1006 coupled to bus 1011 for storing static information and instructions for main processing unit 1012. The static storage device 1006 may store OS level and application level software.

Computer system 1000 may further be coupled to or have an integral display device 1021, such as a liquid crystal display (LCD), coupled to bus 1011 for displaying information to a computer user. A chipset may interface with the display device 1021.

An alphanumeric input device (keyboard) 1022, including alphanumeric and other keys, may also be coupled to bus 1011 for communicating information and command selections to main processing unit 1012. An additional user input device is cursor control device 1023, such as a mouse, trackball, trackpad, stylus, or cursor direction keys, coupled to bus 1011 for communicating direction information and command selections to main processing unit 1012, and for controlling cursor movement on a display device 1021. A chipset may interface with the input output devices.

Another device that may be coupled to bus 1011 is a power supply such as a battery and Alternating Current adapter circuit. Furthermore, a sound recording and playback device, such as a speaker and/or microphone (not shown) may optionally be coupled to bus 1011 for audio interfacing with computer system 1000. Another device that may be coupled to bus 1011 is a wireless communication module 1025. The wireless communication module 1025 may employ a Wireless Application Protocol to establish a wireless communication channel. The wireless communication module 1025 may implement a wireless networking standard such as Institute of Electrical and Electronics Engineers (IEEE) 802.11 standard, IEEE std. 802.11-1999, published by IEEE in 1999.

Accordingly, on average, the methods and apparatus for reducing power consumption described herein, reduce power consumption significantly. In a system without charge sharing, the power consumption by a black screen alternating with a white screen is nearly the same as a screen with a checkerboard pattern with every pixel having a different state than the pixel adjacent to it. However, in a system with charge sharing, then some power savings will be realized in the checkerboard situation compared to the all black/all white situation due to charge sharing within the state transition.

Accordingly, on average, the methods and apparatus for reducing power consumption described herein, reduce power consumption significantly in mobile computing devices. Examples of mobile computing devices may be a laptop computer, a cell phone, a personal digital assistant, or other similar device with on board processing power and wireless communications ability that is powered by a Direct Current (DC) power source that supplies DC voltage to the mobile device and that is solely within the mobile computing device and needs to be recharged on a periodic basis, such as a fuel cell or a battery.

Reference in the specification to an embodiment or some embodiments of the invention means that a particular feature, structure or characteristic described in connection with the embodiment is included in at least one embodiment of the invention. Thus, the appearances of the phrase "in some embodiments" or "according to some embodiments" appearing in various places throughout the specification are not necessarily all referring to the same embodiment.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention. The present invention may be implemented by hardware, software, firmware, microcode, or any combination thereof. When implemented in software, firmware, or microcode, the elements of the present invention are the program code or code segments to perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc. The program or code segments may be stored in a processor readable medium or transmitted by a computer data signal embodied in a carrier wave, or a signal modulated by a carrier, over a transmission medium. The "processor readable medium" may include any medium that can store or transfer information. Examples of the processor readable medium include an electronic circuit, a semiconductor memory device, a ROM, a flash memory, an erasable ROM (EROM), a floppy diskette, a compact disk (CD-ROM), an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

It is noted that the invention may be described as a process which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

What is claimed is:

1. A method comprising:

determining if a first pixel and a second pixel of an active area of a display are to undergo a state transition;

determining if a third pixel of the display will not undergo a state transition;

if so, connecting the first pixel to a common bus, wherein the second pixel is also connected to the common bus, for sharing charge on the first pixel with charge on the second pixel, wherein the first pixel is to undergo a state transition from a higher to a lower charge value and the second pixel is to undergo a state transition from a lower to a higher charge value.

2. The method recited in claim 1, further comprising:

comparing a previous state of the first pixel with a new desired state.

3. The method recited in claim 1, further comprising:

disconnecting the first pixel from a pixel driver.

4. The method recited in claim 3, further comprising:

connecting only the pixels of the display to the common bus that are to undergo a state transition.

5. The method recited in claim 3, wherein when charge on the first pixel becomes equal to a charge on the common bus, disconnecting the first pixel from the common bus and connecting the first pixel to the pixel driver, wherein the second pixel is also disconnected from the common bus.

6. The method recited in claim 5, further comprising:

changing the state of the first pixel to the newly desired state by driving the charge on the first pixel from a value equal to a charge on the common bus to a value corresponding to the newly desired state.

7. The method recited in claim 1, wherein the determination that a pixel is to undergo a state transition is made locally to the pixel.

8. A display comprising:

decision logic to determine if a first pixel and a second pixel of the display are to undergo a state transition, wherein the first pixel is to undergo a state transition from a higher to a lower charge value and the second pixel is to undergo a state transition from a lower to a higher charge value; and charge sharing switch logic to share charge on the first pixel with charge on a second pixel by connecting the first pixel to a common bus, wherein the second pixel is also connected to the common bus.

9. The display recited in claim 8 wherein the decision logic compares a previous state of the first pixel with a new desired state.

10. The display recited in claim 8, wherein the charge sharing switch logic disconnects the first pixel from a pixel driver and connects the first pixel to a common bus, wherein the second pixel is also connected to the common bus.

11. The display recited in claim 10, wherein when charge on the first pixel becomes equal to a charge on the common bus, the charge sharing switch logic to disconnect the pixels from the common bus and connect the pixels to corresponding pixel drivers.

12. The display recited in claim 11, wherein the pixel driver corresponding to the first pixel changes the state of the first pixel to the lower charge value and the pixel driver corresponding to the second pixel changes the state of the second pixel to the higher charge value.

13. The display recited in claim 8, wherein the charge sharing switch logic connects only the pixels of the display to the common bus that are to undergo a state transition.

14. The display recited in claim 8, wherein the decision logic makes a decision local to a pixel about whether the pixel's output state is going to change.

15. A computer system comprising:

a display having active area of pixels, the display further comprising decision logic to isolate pixels of the display are to undergo a state transition, and charge sharing switch to share charge among the pixels isolated by the decision logic; and a DC power source to supply DC power to the display, wherein the charge sharing switch connects the pixels isolated by the decision logic to the bus for sharing charge.

16. The computer system recited in claim 15, further comprising:

a bus for sharing charge among the pixels of the active area.

17. The computer system recited in claim 15, wherein the active area implements bistable technology.

18. The computer system recited in claim 15, wherein the decision logic makes a decision local to a pixel about whether the pixel's output state is going to change.

19. The computer system recited in claim 15, wherein the computer system is a mobile computer platform with a battery for the DC power supply and having a wireless communication module.

* * * * *